US006692374B1

(12) United States Patent
Colbo

(10) Patent No.: US 6,692,374 B1
(45) Date of Patent: Feb. 17, 2004

(54) GOLF CLUB HANDGRIP END MOUNTABLE GOLF BALL RETRIEVING DEVICE

(76) Inventor: Kenneth G. Colbo, 283 W. Front, Ste. 302, Missoula, MT (US) 59802

( * ) Notice: Subject to any disclaimer, the term of this patent is extended or adjusted under 35 U.S.C. 154(b) by 0 days.

(21) Appl. No.: 10/302,591

(22) Filed: Nov. 21, 2002

Related U.S. Application Data

(63) Continuation-in-part of application No. 10/193,855, filed on Jul. 11, 2002.

(51) Int. Cl.[7] ..... K63B 57/00
(52) U.S. Cl. ..... 473/286; 294/19.2
(58) Field of Search ..... 473/286, 285; 294/19.1, 19.2

(56) References Cited

U.S. PATENT DOCUMENTS

| | | | | |
|---|---|---|---|---|
| 2,524,527 A | * | 10/1950 | Jasmer | 294/19.2 |
| 2,943,856 A | | 7/1960 | Eimerman | |
| 3,773,374 A | * | 11/1973 | D'Luhy | 294/19.2 |
| 3,904,200 A | | 9/1975 | Jackle et al. | |
| 4,589,661 A | | 5/1986 | Attig | |
| 4,616,826 A | | 10/1986 | Trefts | |
| 4,714,250 A | | 12/1987 | Henthorn | |
| 4,819,938 A | | 4/1989 | Hill | |
| 4,949,961 A | | 8/1990 | Milano | |
| 5,080,357 A | | 1/1992 | Wolf | |
| 5,102,139 A | * | 4/1992 | Greig | 473/286 |
| 5,306,000 A | | 4/1994 | Comella | |
| 5,690,558 A | * | 11/1997 | Huber | 473/286 |

* cited by examiner

*Primary Examiner*—Steven Wong
(74) *Attorney, Agent, or Firm*—Flanagan & Flanagan; John R. Flanagan

(57) ABSTRACT

A retrieving device includes a support bracket and an expandable ball holder member which has a pair of arms with outer end portions capable of being flexed away from one another and having oppositely curved configurations, and an intermediate structure rigidly interconnecting inner end portions of the arms and pivotally connected to the lower end of the support bracket such that the expandable member is pivotally movable between a first position in which it extends alongside the support bracket and a second position in which it extends outwardly from the lower end of the support bracket such that when the retrieving device is used to retrieve a golf ball with the expandable member in the second position the outer end portions of the arms thereof are forced against the golf ball causing their outward flexing from one another to fit around and support the golf ball for lifting it.

12 Claims, 3 Drawing Sheets

GOLF CLUB HANDGRIP END MOUNTABLE GOLF BALL RETRIEVING DEVICE

This application is a continuation-in-part of application Ser. No. 10/193,855 filed Jul. 11, 2002.

BACKGROUND OF THE INVENTION

1. Field of the Invention

The present invention generally relates to devices for retrieving or picking up a golf ball, such as picking up and removing a golf ball from a cup on a golf course green, and, more particularly, is concerned with a golf club handgrip end mountable golf ball retrieving device.

2. Description of the Prior Art

It has been estimated that an average golfer bends over more than seventy times during a round of golf. This poses a major problem for many golfers in that due to an assortment of medical conditions they experience pain in their back, hips and/or knees in stooping or bending from a standing position and so have difficulty in playing a round of golf. Further, the golfing population has an increasing number of seniors and handicapped golfers who experience this same difficulty due to inability to stoop or bend from a standing position. As a result, many of these golfers have little choice but to quit playing golf.

A variety of devices have been proposed in the prior art to reduce the need for golfers to have to stoop or bend during a round of golf. Representative of such prior art devices are the ones disclosed in U.S. Pat. No. 3,904,200 to Jackle et al., U.S. Pat. No. 4,589,661 to Attig, U.S. Pat. No. 4,616,826 to Trefts, U.S. Pat. No. 4,714,250 to Henthorn, U.S. Pat. No. 4,819,938 to Hill, U.S. Pat. No. 4,949,961 to Milano, U.S. Pat. No. 4,951,947 to Kopfle, U.S. Pat. No. 5,080,357 to Wolf and U.S. Pat. No. 5,306,000 to Comella. While most of these prior art devices appear to be satisfactory in use for the specific purposes for which they were designed, none of them seem to provide a specific solution for the problem at hand. Most of these prior art devices enable the placing of a ball and a tee in the ground without bending over but fail to address the problem of retrieving a ball from a cup without bending over and fail to be sufficiently small in size as to be easily and conveniently carried in a golfer's pocket. U.S. Pat. No. 2,943,856 to Eimerman discloses a golf ball and tee handling device which is relatively small in size and adapted to be mounted to an end of a handle portion of a golf club to enable the placing of a ball and tee in the ground without bending over. A clip is provided on the device so that it may be attached to a golf bag or to wearing apparel of the golfer for convenient portability when it is not in use. This device also fails to address the problem of retrieving a ball from a cup without bending over.

Also, it is known in the prior art to provide a suction cup attached in some manner to the handgrip of a putter to reduce the need for golfers to have to stoop or bend during a round of golf to retrieve or pick up a golf ball and, particularly, to remove the golf ball from the cup on a golf course green. However, the use of a suction cup raises the following problems. First, to be used effectively the suction cup needs to be permanently taped to the handgrip end of the putter. Many golfers find the presence of the suction cup on the grip end of the putter to be unacceptable in that it interferes with their use of the putter. Second, suction cups over time tend to dry out and thus loose their ability to couple with the golf ball and lift it from the cup. Third, the suction cup sometimes becomes detached from the putter handgrip end when the putter is removed from the golf bag. The suction cup thus ends up in the bottom of the golf bag.

Consequently, a need still exists for an innovation which will provide an effective solution to the aforementioned problems without introducing new problems in place thereof.

SUMMARY OF THE INVENTION

The present invention provides a golf ball retrieving device designed to satisfy the aforementioned need. The golf ball retrieving device of the present invention is mountable on a golf club handgrip end for use in retrieving or picking up a golf ball and when not in use is removed and folded to a compact condition for storing in a pocket of the golfer's clothing or golf bag. The golf ball retrieving device of the present invention effectively eliminates all of the problems experienced heretofore with the use of suction cups.

Accordingly, the present invention is directed to a golf ball retrieving device which comprises: (a) a support bracket having upper and lower ends; and (b) an expandable ball holder member including (i) a pair of arms having respective inner end portions and respective outer end portions extending from the inner end portions and capable of being flexed away from one another and being of oppositely curved configurations, and (ii) an intermediate structure extending between and rigidly interconnecting the arms at the respective inner end portions thereof, the intermediate structure being pivotally connected to the lower end of the support bracket such that the expandable ball holder member is pivotally movable between a first position in which the expandable ball holder member extends alongside the support bracket so as to place the retrieving device in a folded compact condition and a second position in which the expandable ball holder member extends transverse to the support bracket outwardly from the lower end of the support bracket and beyond the support bracket so as to place the retrieving device in an unfolded deployed condition in which when the retrieving device is used to retrieve a golf ball the respective outer end portions of the arms are forced against the golf ball causing the outer end portions to flex outwardly away from one another so as to fit around and support the golf ball for lifting the golf ball.

Additionally, the support bracket has a pair of opposite lateral sides extending between the upper and lower ends of the support bracket and a transverse opening formed through the lower end of said support bracket and between and open at the opposite lateral sides thereof. Also, the intermediate structure of the expandable ball holder member includes a first cross shaft which extends between and rigidly interconnects the respective inner end portions of the arms of the expandable ball holder member and is received within the transverse opening formed in the lower end of the support bracket such that the first cross shaft rotates within the transverse opening so as to pivotally mount the expandable ball holder member to the support bracket for undergoing the pivotal movement between the first and second positions.

Further, the support bracket has opposite rear and front sides extending between the upper and lower ends of the support bracket and first and second transverse recesses formed in the lower end of the support bracket respectively at the opposite rear and front sides of the support bracket and extending between and open at the opposite lateral sides thereof. The intermediate structure of the expandable ball holder member further includes a second cross shaft spaced from the first cross shaft and extending between and rigidly interconnecting the respective inner end portions of the arms of the expandable ball holder member and receivable within one or the other of the first and second transverse recesses formed in the lower end of the support bracket respectively at the rear and front sides thereof upon pivotal movement of the expandable ball holder member correspondingly to one or the other of the first and second positions. The first transverse recess faces generally away from the upper end of the support bracket.

The ball retrieving device further comprises means on the upper end of the support bracket for removably mounting the support bracket to an end of a handgrip of a golf club for using the golf club to manipulate the retrieving device in retrieving a golf ball. More particularly, the means for removably mounting the support bracket is a connector member having upper and lower ends and being fixedly attached at the lower end to the upper end of the support bracket. The connector member is generally circular in cross-section and smaller in diameter at the upper end than at the lower end such that the connector member progressively decreases in size at least going from an intermediate portion thereof between the upper and lower ends thereof to the upper end thereof such that the upper end is generally pointed to facilitate insertion of at least a portion of the connector member into a hole in the end of the handgrip of the golf club so as to assume a close frictional fitting relationship therewith.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
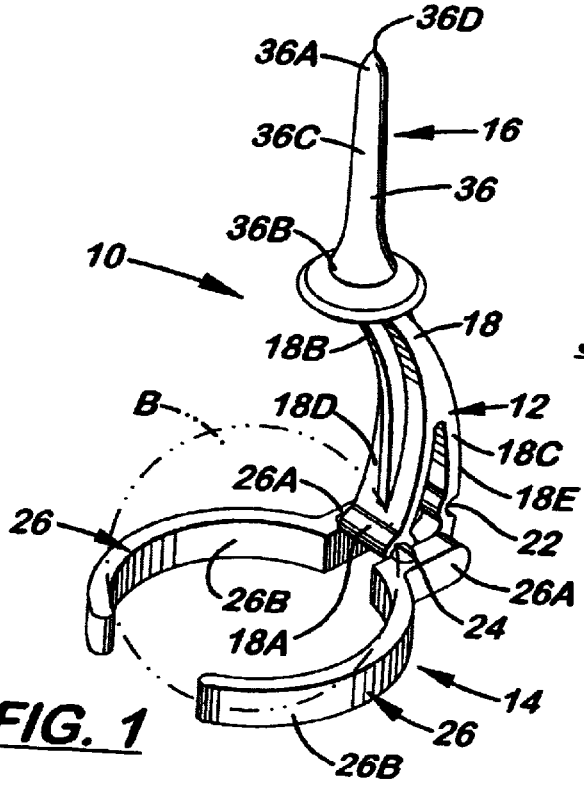
FIG. 1 is a perspective view of a ball retrieving device of the present invention, showing the device in an unfolded deployed condition.

Referring to the drawings and particularly to FIG. 1, there is illustrated a golf ball retrieving device of the present invention, generally designated 10. Basically, the retrieving device 10 includes an elongated support bracket 12 and an expandable ball holder member 14 pivotally mounted to the support bracket 12. Also, the retrieving device 10 includes means 16 for removably mounting the support bracket 12 to an elongated member A, such as a golf club, for using the golf club to manipulate the retrieving device 10 in the retrieving of a golf ball B.

Referring now to FIGS. 1–4, the support bracket 12 of the device 10 has a curved rigid body 18 with opposite lower and upper ends 18A, 18B, opposite lateral sides 18C extending between the lower and upper ends 18A, 18B, and opposite front and rear sides 18D, 18E extending between the lower and upper ends 18A, 18B and opposite lateral sides 18C. The body 18 of the support bracket 12 also has a transverse opening 20 of cylindrical configuration formed through the lower end 18A thereof and extending between and open at the opposite lateral sides 18C thereof. The transverse opening 20 also is open at the front side 18D of the body 18 of the support bracket 12. The body 18 of the support bracket 12 further has first and second transverse recesses 22, 24 of cylindrical configuration formed in the lower end 18A of the body 18 respectively at the opposite rear and front sides 18E, 18D thereof and extending between and open at the opposite lateral sides 18C thereof.

Figure 6:
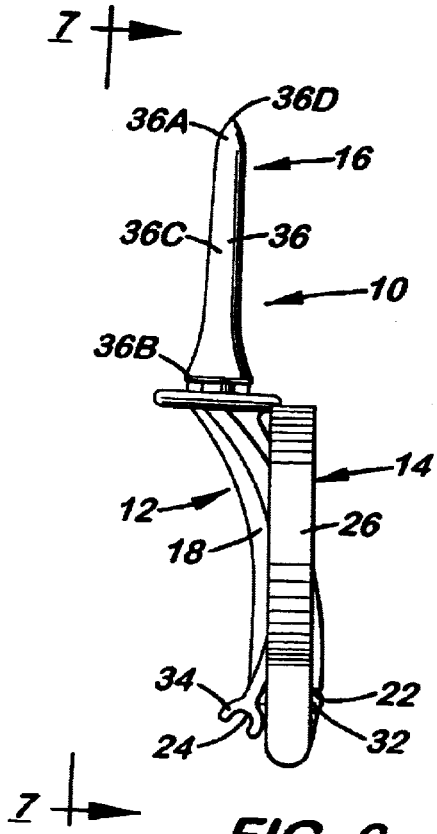
FIG. 6 is a side elevational view of the ball retrieving device shown disposed in a folded compact condition.
Figure 7:
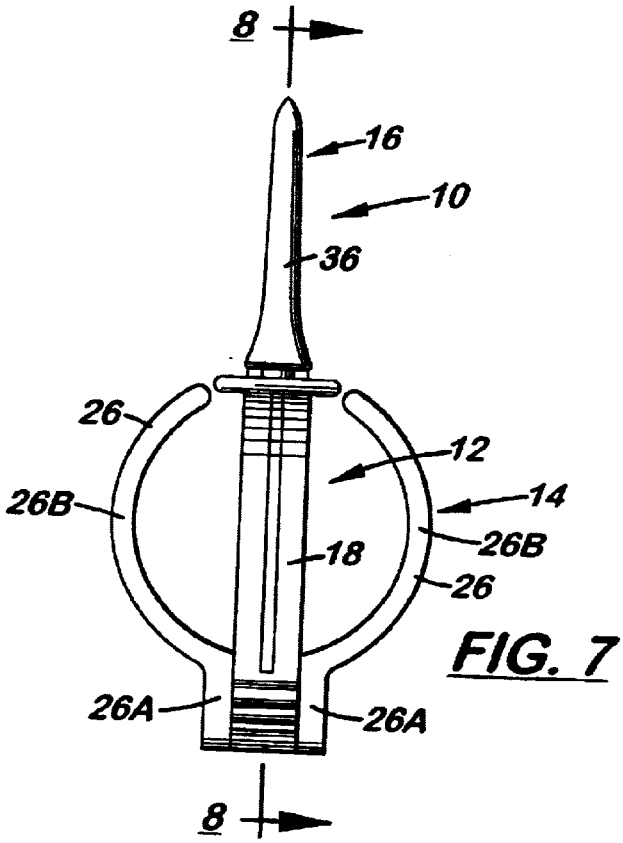
FIG. 7 is a front elevational view of the ball retrieving device as seen along line 7—7 of FIG. 6.
Figure 8:
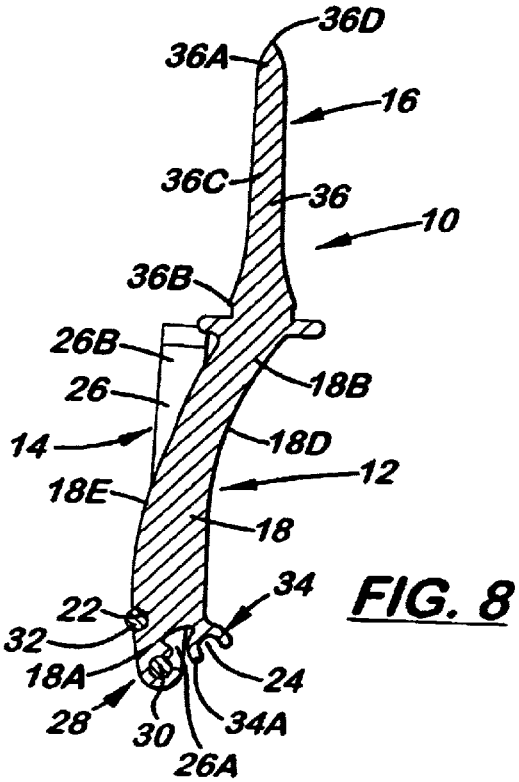
FIG. 8 is a longitudinal sectional view of the ball retrieving device as taken along line 8—8 of FIG. 7.

The expandable ball holder member 14 of the device 10 includes a pair of arms 26 and an intermediate structure 28. The arms 26 have respective inner end portions 26A and respective outer end portions 26B merging and extending from the inner end portions 26A and capable of being flexed away from one another. The outer end portions 26B of the arms 26 are of oppositely curved, particularly semi-circular, configurations. The intermediate structure 28 extends between and rigidly interconnects the arms 26 at the respective inner end portions 26A thereof. More particularly, the intermediate structure 28 includes a first cross shaft 30, of cylindrical configuration, extending between and rigidly interconnecting the respective inner end portions 26B of the arms 26 and received within the transverse opening 20 formed in the lower end 18A of the body 18 of the support bracket 12 such that the first cross shaft 30 rotates within the transverse opening 20 so as to pivotally mount the expandable ball holder member 14 to the support bracket 12 for undergoing pivotal movement between a first position, as seen in FIGS. 6–8, in which the expandable ball holder member 14 extends alongside the support bracket 12 so as to place the retrieving device 10 in a folded compact condition, as seen in FIGS. 6–8 and a second position in which the expandable ball holder member 14 extends transverse to the support bracket, as seen in FIGS. 1–4, outwardly from the lower end 18A of the body 18 of the support bracket 12 and beyond the support bracket 12 so as to place the retrieving device 10 in an unfolded deployed condition, as seen in FIGS. 1–4, in which when the retrieving device is used to retrieve the golf ball B the respective outer end portions 26B of the arms 26 are forced downward over and against the golf ball B causing the outer end portions 26B to flex outwardly away from one another, as shown in dashed line form in FIG. 3, so as to fit around and support the golf ball B for lifting the golf ball B from the surface of a golf course or from a cup on a golf course green. The transverse opening 20 of the support bracket 12 by being open at the front side 18D of the body 18 of the support bracket 12 allows insertion of the first cross shaft 30 of the expandable ball holder member 14 therein to pivotally mount the expandable ball holder member 14 to the support bracket 12 of the retrieving device 10.

Figure 2:
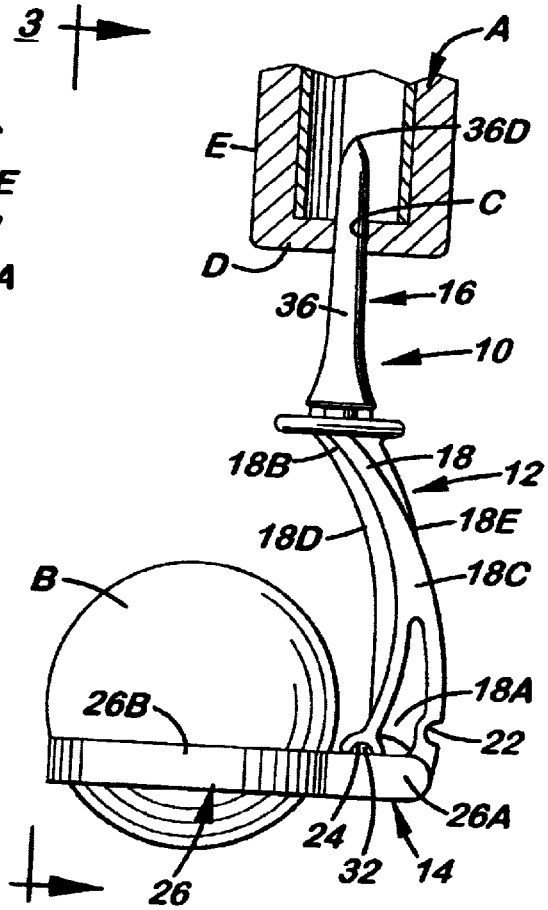
FIG. 2 is a side elevational view of the ball retrieving device shown mounted to an end of a handgrip of a golf club and disposed in the deployed condition.
Figure 3:
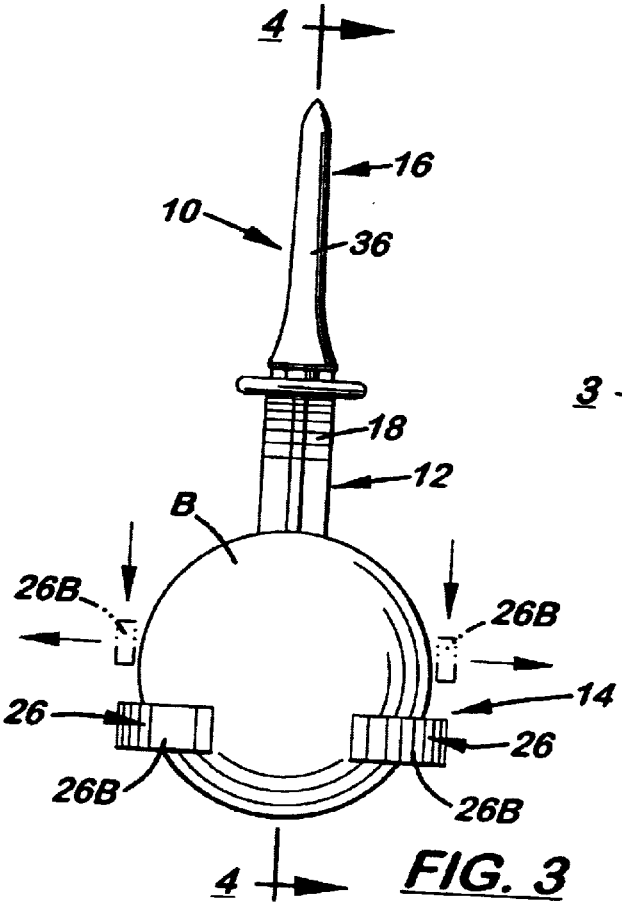
FIG. 3 is a front elevational view of the ball retrieving device as seen along line 3—3 of FIG. 2.

Also, the intermediate structure 28 of the expandable ball holder member 14 includes a second cross shaft 32 spaced from the first cross shaft 30 and rigidly interconnecting and extending between the respective inner end portions 26A of the arms 26 of the expandable ball holder member 14 and receivable within one or the other of the first and second transverse recesses 22, 24 formed in the lower end 18A of the body 18 of the support bracket 12 respectively at the rear and front sides 18E, 18D thereof upon pivotal movement of the expandable ball holder member 14 to below and past the lower end 18A of the body 18 of the support member 18 and correspondingly to one or the other of the first and second positions, respective seen in FIGS.2 and 6. As seen in FIGS. 1 and 7, the respective lower end portions 26A of the arms 26 of the expandable ball holder member 14 extend generally parallel to one another and the first and second cross shafts 30, 32 extend generally perpendicular to the lower end portions 26A of the arms 26.

Figure 4:
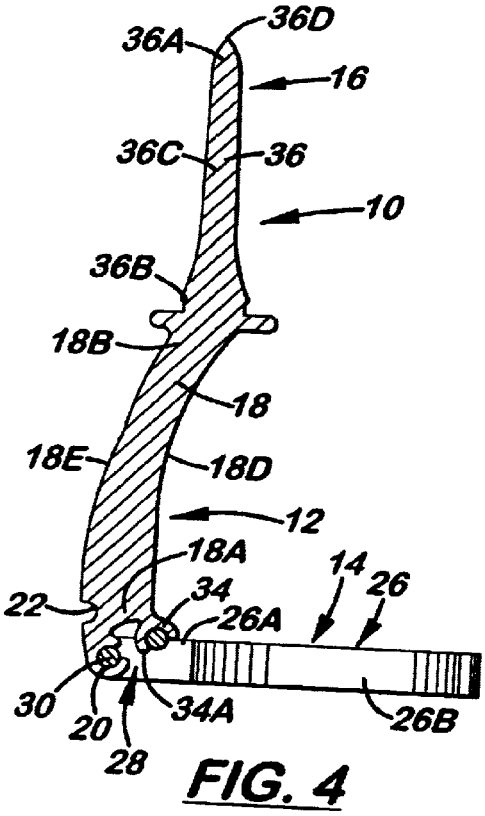
FIG. 4 is a longitudinal sectional view of the ball retrieving device as taken along line 4—4 of FIG. 3.
Figure 5:
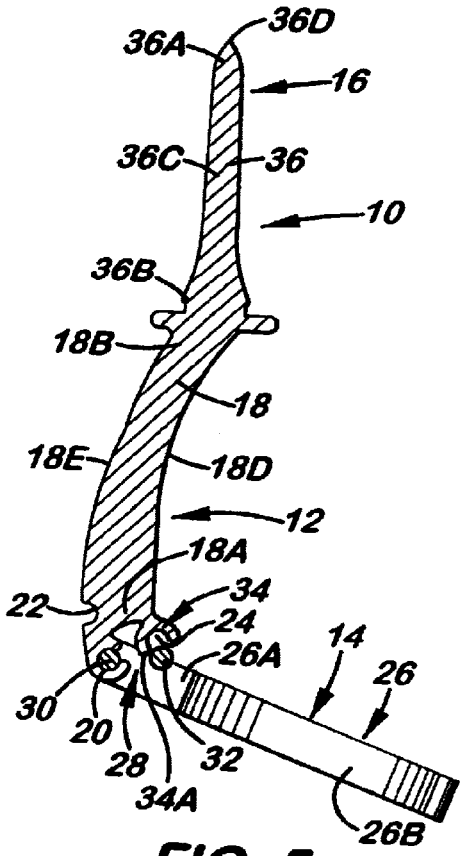
FIG. 5 is a view similar to that of FIG. 4 but showing the position of an expandable ball holder member of the device relative to a support bracket thereof immediately before the device is placed in its unfolded deployed condition.

Referring to FIGS. 4 and 5, it is seen that the second transverse recess 24 is defined by a semi-circular seat 34 formed on the lower end 18A of the body 18 of the support bracket 12 so as to face generally downward and away from the upper end 18B of the body 18 of the support bracket 12. The second cross shaft 32 is disposed relative to the semi-circular seat 34 such that it engages a lower edge 34A of the seat 34 and causes the lower edge 34A to flex slightly so as to allow the second cross shaft 32 to move pass the lower edge 34A of the seat 34 and enter the second transverse recess 24 with an over-centering type of force that retains the second cross shaft 32 therein until a sufficient counter force is applied to the expandable ball holder member 14 to remove the second cross shaft 32 from the second transverse recess 24. This over-centering type of force retains the retrieving device 10 in the unfolded deployed condition until such counter force is applied.

The means 16 for removably mounting the support bracket 12 on the elongated member A, such as a golf club, is a connector member 36. The connector member 36 has upper and lower ends 36A, 36B and is fixedly or integrally attached at the lower end 36B to the upper end 18B of the body 18 of the support bracket 12. The connector member 36, being shaped similar to a golf tee, is generally circular in cross-section and smaller in diameter at the upper end 36A than at the lower end 36B such that the connector member 36 progressively decreases in size at least going from an intermediate portion 36C thereof between the upper and lower ends 36A, 36B thereof to the upper end 36A thereof such that the upper end 36A terminates in a point 36D to facilitate removable insertion of at least a portion of the connector member 36 into a hole C in an end D of a handgrip E of the golf club A so as to assume a close frictional fitting relationship therewith.

The support bracket 12, expandable ball holder member 14 and connector member 36 preferably are manufactured of any suitable conventional plastic material using conventional injection molding techniques. The support bracket 12 and connector member 36 are preferably molded as a one-piece unit with the expandable member 14 being molded as a separate piece which is assembled to the support bracket 12.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A golf ball retrieving device, comprises:

(a) a support bracket having upper and lower ends, a pair of opposite lateral sides extending between said upper and lower ends, a transverse opening formed through said lower end and between and open at said opposite lateral sides, opposite rear and front sides extending between said upper and lower ends, and first and second transverse recesses formed in said lower end respectively at said opposite rear and front sides and extending between and open at said opposite lateral sides; and (b) an expandable ball holder member including (i) a pair of arms having respective inner end portions and respective outer end portions extending from said inner end portions and capable of being flexed away from one another and being of oppositely curved configurations, and (ii) an intermediate structure extending between and rigidly interconnecting said arms at said respective inner end portions thereof, said intermediate structure being pivotally connected to said lower end of said support bracket such that said expandable ball holder member is pivotally movable between a first position in which said expandable ball holder member extends alongside said support bracket so as to place said retrieving device in a folded compact condition and a second position in which said expandable ball holder member extends transverse to said support bracket outwardly from said lower end of said support bracket and beyond said support bracket so as to place said retrieving device in an unfolded deployed condition in which when said retrieving device is used to retrieve a golf ball said respective outer end portions of said arms are forced against the golf ball causing said outer end portions to flex outwardly away from one another so as to fit around and support the golf ball for lifting the golf ball.

(iii) said intermediate structure including a first cross shaft rigidly interconnecting and extending between said respective inner end portions of said arms and received within said transverse opening formed in said lower end of said support bracket such that said first cross shaft rotates within said transverse opening so as to pivotally mount said expandable ball holder member to said support bracket for undergoing pivotal movement between said first and second positions, (iv) said intermediate structure further including a second cross shaft spaced from said first cross shaft and rigidly interconnecting and extending between said respective inner end portions of said arms and receivable within one or the other of said first and second transverse recesses formed in said lower end of said support bracket respectively at said rear and front sides thereof upon pivotal movement of said expandable ball holder member correspondingly to one or the other of said first and second positions.

2. The device of claim 1 wherein said respective inner end portions of said arms of said expandable ball holder member extend generally parallel to one another and said first cross shaft extends generally perpendicular to said inner end portions of said arms.

3. The device of claim 1 wherein said transverse opening of said support bracket also is open at said front side of said support bracket so as to allow insertion of said first cross shaft of said expandable ball holder member therein to pivotally mount said expandable ball holder member to said support bracket.

4. The device of claim 1 wherein said second transverse recess is defined by a semi-circular seat formed on said lower end of said support bracket so as to face generally downward and away from said upper end of said support bracket.

5. The device of claim 1 wherein said respective lower end portions of said arms of said expandable ball holder member extend generally parallel to one another and said first and second cross shafts extend generally perpendicular to said inner end portions of said arms.

6. A golf ball retrieving device, comprising:

(a) an elongated support bracket having upper and lower ends, pair of opposite lateral sides extending between said upper and lower ends, a transverse opening formed through said lower end and between and open at said opposite lateral sides, opposite rear and front sides extending between said upper and lower ends, and first and second transverse recesses formed in said lower end respectively at said opposite rear and front sides and extending between and open at said opposite lateral sides;

(b) means on said upper end of said support bracket for removably mounting said support bracket to an end of a handgrip of a golf club for using the golf club to manipulate said retrieving device in retrieving a golf ball; and (c) an expandable ball holder member including (i) a pair of arms having respective inner end portions and respective outer end portions extending from said inner end portions and capable of being flexed away from one another and being of oppositely curved configurations, and (ii) an intermediate structure extending between and rigidly interconnecting said arms at said respective inner end portions thereof, said intermediate structure being pivotally connected to said lower end of said support bracket such that said expandable ball holder member is pivotally movable between a first position in which said expandable ball holder member extends alongside said support bracket so as to place said retrieving device in a folded compact condition and a second position in which said expandable ball holder member extends transverse to said support bracket outwardly from said lower end of said support bracket and beyond said support bracket so as to place said retrieving device in an unfolded deployed condition in which when said retrieving device is used to retrieve a golf ball said respective outer end portions of said arms are forced against the golf ball causing said outer end portions to flex outwardly away from one another so as to fit around and support the golf ball for lifting the golf ball, (iii) said intermediate structure including a first cross shaft rigidly interconnecting and extending between said respective inner end portions of said arms and received within said transverse opening formed in said lower end of said support bracket such that said first cross shaft rotates within said transverse opening so as to pivotally mount said expandable ball holder member to said support bracket for undergoing pivotal movement between said first and second positions, (iv) said intermediate structure further including a second cross shaft spaced from said first cross shaft and rigidly interconnecting and extending between said respective inner end portions of said arms and receivable within one or the other of said first and second transverse recesses formed in said lower end of said support bracket respectively at said rear and front sides thereof upon pivotal movement of said expandable ball holder member correspondingly to one or the other of said first and second positions.

7. The device of claim 6 wherein said means for removably mounting said support bracket is a connector member having upper and lower ends and being fixedly attached at said lower end to said upper end of said support bracket.

8. The device of claim 7 wherein said connector member is generally circular in cross-section and smaller in diameter at said upper end than at said lower end such that said connector member progressively decreases in size at least going from an intermediate portion thereof between said upper and lower ends thereof to said upper end thereof such that said upper end is generally pointed to facilitate insertion of at least a portion of said connector member into a hole in an end of a handgrip of a golf club so as to assume a close frictional fitting relationship therewith.

9. The device of claim 6 wherein said respective inner end portions of said arms of said expandable ball holder member extend generally parallel to one another and said first cross shaft extends generally perpendicular to said lower end portions of said arms.

10. The device of claim 6 wherein said transverse opening of said support bracket also is open at said front side of said support bracket so as to allow insertion of said first cross shaft of said expandable ball holder member therein to pivotally mount said expandable ball holder member to said support bracket.

11. The device of claim 6 wherein said second transverse recess is defined by a semi-circular seat formed on said lower end of said support bracket so as to face generally downward and away from said upper end of said support bracket.

12. The device of claim 6 wherein said respective lower end portions of said arms of said expandable ball holder member extend generally parallel to one another and said first and second cross shafts extend generally perpendicular to said lower end portions of said arms.

* * * * *